US008104580B2

(12) United States Patent
Eriksson

(10) Patent No.: US 8,104,580 B2
(45) Date of Patent: Jan. 31, 2012

(54) LOCKING MECHANISM FOR A LADDER

(75) Inventor: Per-Olof Eriksson, Tranäs (SE)

(73) Assignee: Telesteps AB, Tranas (SE)

( * ) Notice: Subject to any disclaimer, the term of this patent is extended or adjusted under 35 U.S.C. 154(b) by 937 days.

(21) Appl. No.: 11/921,391

(22) PCT Filed: May 29, 2006

(86) PCT No.: PCT/EP2006/062676

§ 371 (c)(1),
(2), (4) Date: Nov. 30, 2007

(87) PCT Pub. No.: WO2006/128845

PCT Pub. Date: Dec. 7, 2006

(65) Prior Publication Data

US 2009/0050407 A1 Feb. 26, 2009

(30) Foreign Application Priority Data

Jun. 1, 2005 (EP) ..... 05011809

(51) Int. Cl.
*E06C 1/00* (2006.01)

(52) U.S. Cl. ..... 182/195

(58) Field of Classification Search ..... 182/195
See application file for complete search history.

(56) References Cited

U.S. PATENT DOCUMENTS

| | | | | |
|---|---|---|---|---|
| 4,989,692 | A * | 2/1991 | Min | 182/166 |
| 5,495,915 | A * | 3/1996 | Weston et al. | 182/195 |
| 5,743,355 | A * | 4/1998 | McDonnell et al. | 182/195 |
| 6,883,885 | B2 * | 4/2005 | Judge et al. | 312/334.46 |
| 2004/0195043 | A1 * | 10/2004 | Johansson | 182/195 |

FOREIGN PATENT DOCUMENTS

| | | | |
|---|---|---|---|
| DE | 2454271 | A * | 6/1975 |
| EP | 0 527 766 | A | 2/1993 |
| EP | 1 402 143 | | 3/2004 |
| RU | 2101453 | C1 | 1/1998 |
| SU | 1040104 | A | 9/1983 |

* cited by examiner

*Primary Examiner* — Alvin Chin Shue
(74) *Attorney, Agent, or Firm* — Breiner & Breiner, L.L.C.

(57) ABSTRACT

A locking mechanism for a collapsible ladder (1) comprising several ladder sections (5), each ladder section comprising two ladder bars (2, 3) arranged parallel to each other and interconnected at one end by a rung to form a U-shaped ladder section, and where each ladder section (5) is telescopically inserted into a lower ladder section to form a collapsible ladder (1), and where dampers (23) are provided at the lower end of the ladder bars (2, 3, and where the locking mechanism comprises retaining mechanisms (20, 41) provided on each ladder bar (2, 3), where a single pair of actuators of the locking mechanism can be arranged on any of the ladder sections (5) and still be able to collapse the entire ladder (1).

16 Claims, 6 Drawing Sheets

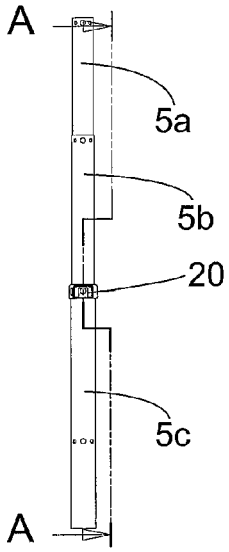
Fig. 5
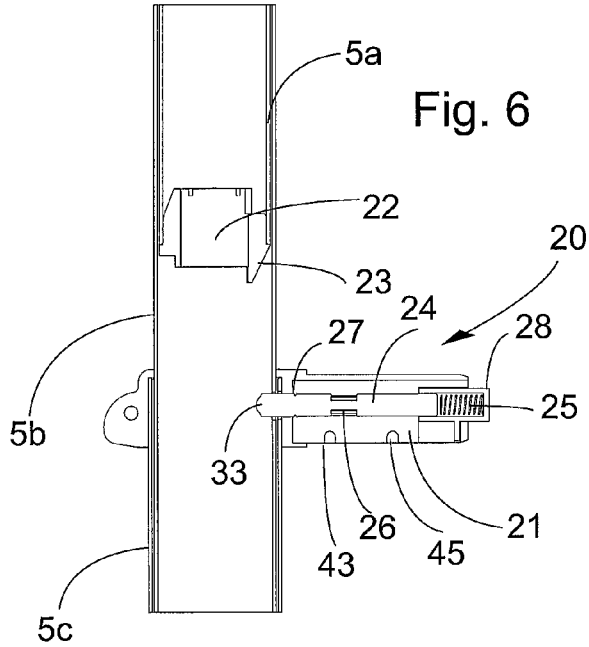
Fig. 6
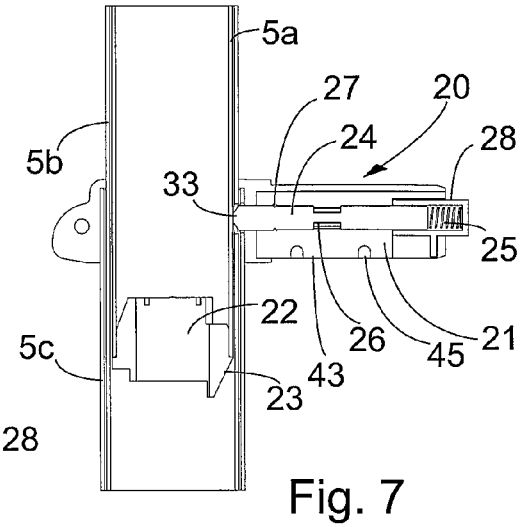
Fig. 7
Fig. 8
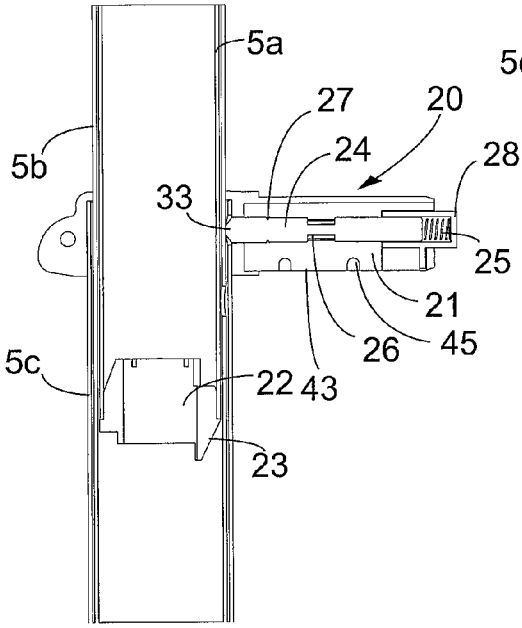

LOCKING MECHANISM FOR A LADDER

AREA OF INVENTION

The present invention relates to a telescopic or collapsible ladder or stepladder of the type comprising U-shaped ladder sections being telescopably inserted in each other, and more specifically to a locking mechanism for such ladders.

BACKGROUND OF INVENTION

Ladders having collapsible and expandable ladder sections are used in order to make the ladder smaller for storage and transport purposes.

In the European patent EP-B1-0 527 766 a collapsible ladder is described comprising ladder bars divided into sections interconnected by rungs. In each ladder section is provided retaining or locking mechanisms, designed to automatically release the upper ladder sections, when a rung reaches a lower rung. This means, that subsequent to the release of the lowermost ladder section, the following ladder sections are automatically released, whereby the ladder collapses.

In the European patent EP-B1-1 402 143 another collapsible ladder is described comprising a retaining or locking mechanism on each ladder section. The locking mechanism is provided at both sides of a ladder section and is designed to be manually and individually released at both sides of a ladder section to collapse a ladder section. The locking mechanism on every ladder section needs to be released to completely collapse the ladder.

One drawback with the ladder described in EP-B1-0 527 766 is that the locking mechanism is positioned on the second lowermost ladder section, which makes it rather uncomfortable to release the ladder. One drawback with the ladder described in EP-B1-1 402 143 is that every ladder section needs to be released individually by the user, which could be rather tiresome for the user. Yet another and greater drawback is if any of the locking mechanisms of EP-B1-0 527 766 or EP-B1-1 402 143 are used in a step-ladder, since both locking mechanisms enable a stepladder having any of these locking mechanisms to be used even though they are not completely extended or if one side of the stepladder is folded or extended more or less than the other side of the stepladder.

There is a wish to provide a locking mechanism for a collapsible ladder or stepladder that combines the benefits of the described prior art solutions without their drawbacks and that ensures the collapsible ladder or stepladder can only be used when the ladder is completely extended.

SUMMARY OF INVENTION

An object of the present invention is to provide a locking mechanism for telescopably collapsible ladders and stepladders, which enables the user to comfortably release the locking mechanism and automatically collapse the ladder by a single locking mechanism arranged on the upper ladder sections, but also secure that the ladder can only be used when fully extended.

This object is attained according to the invention described in the characterizing part of claim 1.

In a further embodiment of the invention, the retaining mechanism enables to completely fold the ladder by using the retaining mechanism of any bar section.

In still a further embodiment of the invention, the locking mechanism is included in a collapsible ladder.

In another embodiment of the invention, the locking pin position is indicated by a field, preferably with red color, when the locking pin is withdrawn from the respective ladder bar, and by another field, preferably with green color, when the locking pin is in the locking position.

In yet another embodiment of the invention, the locking mechanism is included in a collapsible stepladder.

BRIEF DESCRIPTION OF THE DRAWINGS

In the following, the invention will be explained with reference to the accompanying drawings, where:

FIGS. 5-12 show different views of the locking mechanism according to the first and/or the second embodiment of the invention;

DETAILED DESCRIPTION OF EMBODIMENTS

Figure 1:
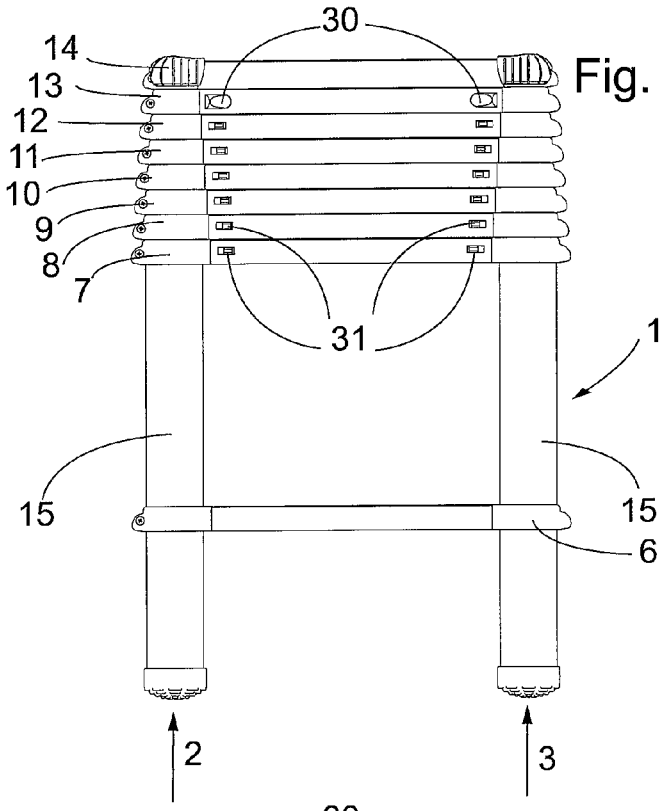
FIG. 1 is a front view of a maximally collapsed ladder according to a first embodiment of the invention.
Figure 2:
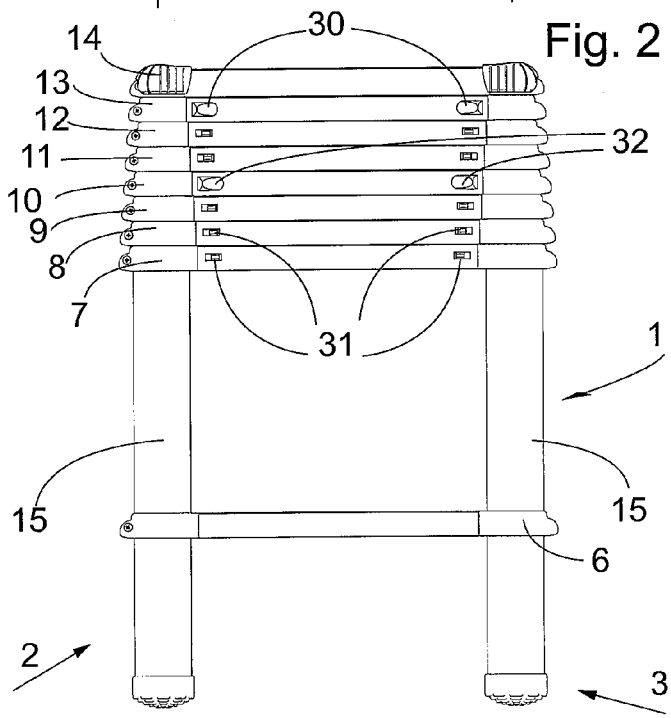
FIG. 2 is a front view of a maximally collapsed ladder according to a second embodiment of the invention.
Figure 3:
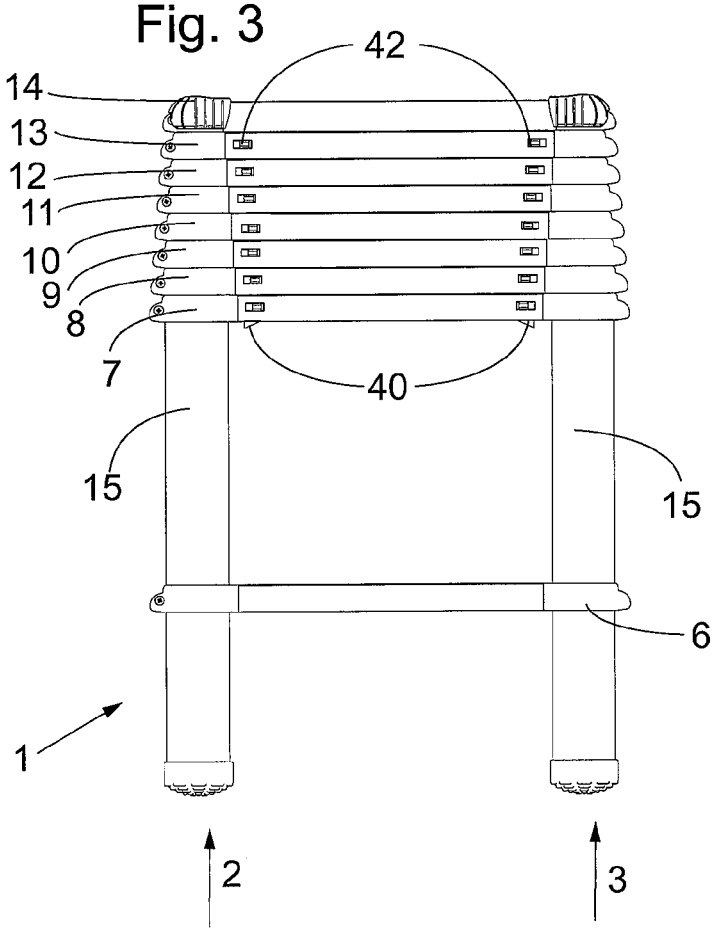
FIG. 3 is a front view of a maximally collapsed ladder according to a third embodiment of the invention.

As can be seen by briefly reviewing the drawings, there are many similarities between FIGS. 1, 2 and 3. Hence, a general description concerning FIGS. 1, 2 and 3 will be given prior to the description of the preferred embodiments of the invention.

In FIGS. 1, 2 and 3 a collapsible ladder 1 is shown comprising ladder bars 2, 3 and rungs 6-14, respectively. The rungs are arranged between the ladder bars 2, 3 and interconnect them. The ladder bars 2, 3 are divided into sections 5 (see FIG. 4*a-b*), which telescope into each other. The bar sections 5 to the right and to the left form U-shaped ladder sections together with the rungs 6-14 connected at the top of the bar sections.

The lowermost ladder section 15 is besides the rung 7 suitably provided at the bottom with a stationary rung 6, designed to provide an extra foot support and a more stable lowermost ladder section. The rungs are suitably made of an extruded aluminum profile.

Each rung 7-13 houses at each end a locking or retaining mechanism 20, 41 (not shown in FIGS. 1-3), comprising a shell 21. The shell 21 is inserted in the profile of the rung, e.g. by means of a press fit. The rung 14 of the uppermost ladder section and the stationary rung 6 may lack a retaining mechanism 20, 41.

FIG. 1 shows a first embodiment of the collapsible ladder 1 having actuators 30 arranged on the top rung 14 to initiate the folding of the ladder. The ladder 1 is furthermore provided with ladder locking indicators 31 on each rung 7-13, where each locking indicator 31 has a green field to indicate that the locking or retaining mechanism 20 associated with that locking indicator 31 is activated and a red field to indicate that the retaining mechanism 20 associated with that locking indicator 31 is inactivated. The functionality of the retaining mechanisms 20 of the embodiment shown in FIG. 1 and the operation of the ladder will be described later in connection with FIGS. 5-12.

FIG. 2 shows a second embodiment of the collapsible ladder 1, which is similar to the first embodiment, but also includes a second pair of actuators 32 arranged on the rung 10 to initiate the folding of the ladder. This second pair of actuators 32 are primarily used if the ladder 1 is fully extended and a user is unable to reach the actuators 30 arranged on the top rung 14 to fold the ladder. The actuators 32 serve to fold the lower part of the ladder, i.e. ladder sections associated with the rungs 7-10, before the actuators 30 are used to fold the upper part of the ladder, i.e. ladder sections associated with the rungs 11-14. It is also possible to have a third pair of actuators if the ladder 1 should be even longer, but it is unlikely since such a ladder would hardly fulfill the requirements for type approval. The functionality of the retaining mechanisms 20 of the embodiment shown in FIG. 2 will be described later in connection with FIGS. 5-12.

Figure 4A:
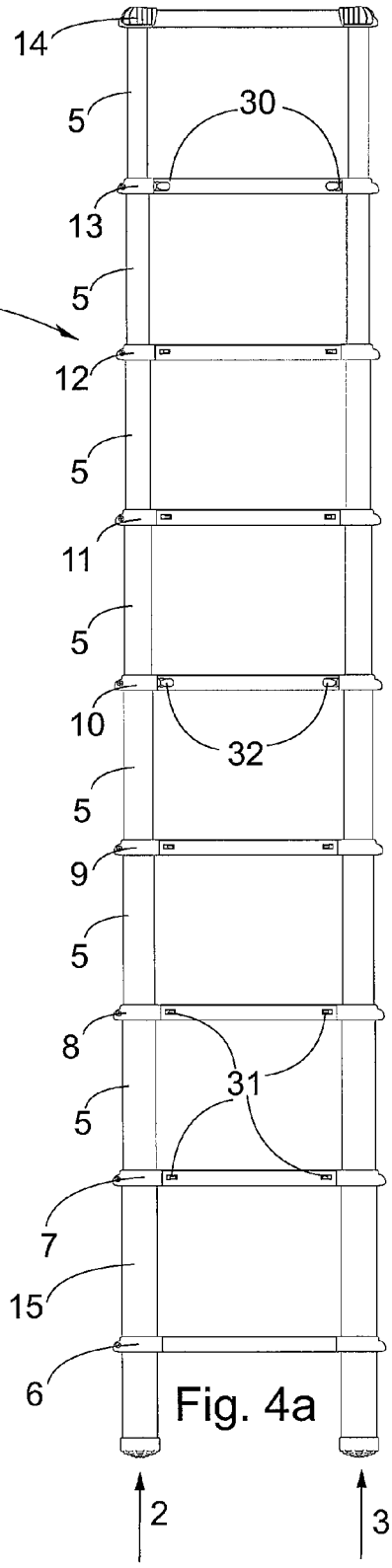
FIG. 4*a* is a front view of an extended ladder according to the third embodiment of the invention.

A completely extended ladder 1 according to the second embodiment is shown in FIG. 4*a*.

FIG. 3 shows a third embodiment of the collapsible ladder 1 having actuators 40 arranged on the rung 7 to initiate the folding of the ladder. The actuators 40 and locking or retaining mechanisms 41 (shown in FIGS. 14-16) associated to or operated by the actuators 40 are able not only to fold or initiate the folding of the ladder sections positioned below the ladder section provided with actuators 40 when the ladder 1 is completely extended as the actuators 30 of the first and second embodiment, but also to fold or initiate the folding of the ladder sections positioned above the ladder section provided with actuators 40. Since the actuators 40 arranged on the rung 7, which not has any foldable or collapsible ladder sections below the rung 7, the actuators 40 arranged on the rung 7 are only able to fold ladder sections positioned above.

The ladder 1 of FIG. 3 is furthermore provided with ladder locking indicators 42 on each rung 7-9 and 11-13, where each locking indicator 42 has a green field to indicate that the retaining mechanism associated with that locking indicator 42 is activated and a red field to indicate that the retaining mechanism associated with that locking indicator 42 is inactivated. The functionality of the retaining mechanisms of the embodiment shown in FIG. 3, which are different from that of FIGS. 1 and 2, will be described later in connection with FIGS. 13-16.

Figure 4B:
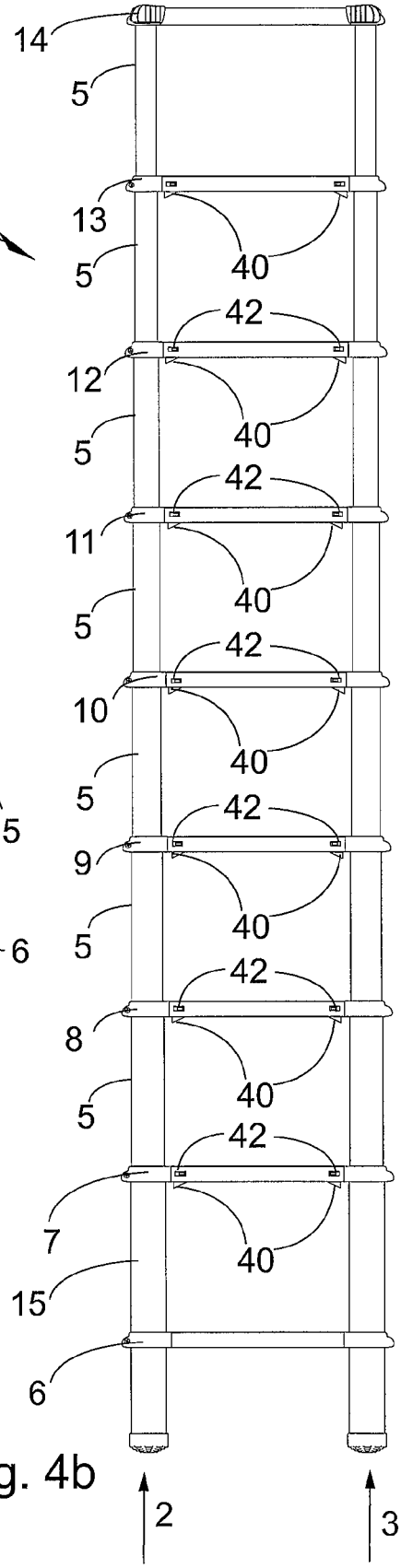
FIG. 4*b* is a front view of an extended ladder according to the second embodiment of the invention.

A completely extended ladder 1 according to the third embodiment is shown in FIG. 4*b* having locking indicators 42 and actuators 40 on each of the rungs 7-13.

Now the retaining or locking mechanism 20 used in the first and second embodiment will be described in detail. In FIG. 5 only three bar sections 5*a*, 5*b*, 5*c* are shown with a retaining mechanism only provided on the bar section 5*c*, whereas the rest of the ladder has been removed for clarity reasons. The bar section 5*a*, having the smaller diameter, telescopes into the bar section 5*b*, and the bar section 5*b* telescopes into the bar section having the greater diameter.

In FIGS. 6-8 a partial cross section of the bar sections 5*a*-5*c* along the line A-A is shown. Every bar section 5, except the lower most bar sections, is provided with a damper 22 at its lower end. The damper 22 serves to reduce the folding speed of the ladder as the bar section is lowered by gravity. The damper 22 is provided with an inclined surface 23.

The retaining mechanism 20 comprises a locking pin 24, which is received in a shell 21, where the shell 21 is press-fitted into the rung. The locking pin 24 is displaceably mounted in the shell 21 and is in one end biased by a spring 25. The locking pin 24 is provided with a waist or recess portion 26 in the mid portion of the locking pin 26 and a slot or slit 27 in the fore portion of the locking pin 24. The waist or recess 26 serves to receive an actuator or button 30, 32 (see FIGS. 10-12) or the ladder locking indicator 31, which both in one end have a connecting part that is jammed over the waist or recess 26.

The ladder locking indicator 31, 42 is, as earlier described, provided with a green field to indicate that the retaining mechanism associated with that locking indicator 31, 42 is activated, and with a red field to indicate that the retaining mechanism associated with that locking indicator 31, 42 is inactivated. These fields are provided on a plate made of plastic or metal attached to the other end of the locking indicator 31, 42, where the plate is vertically arranged in relation to the connecting part. The locking indicator is completely housed in the shell 21, but the plate with the green and red fields is visible through a recess 29 (see FIGS. 10-12) in the front of the rungs.

Figure 10:
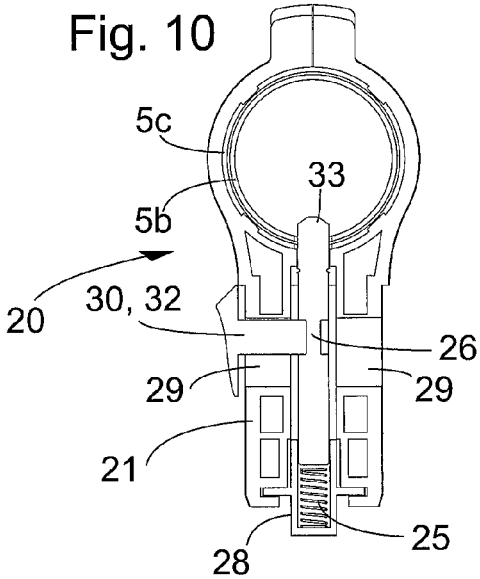

When the locking pin 24 is in the position shown in FIGS. 6 and 10, i.e. in the engaged or locking position, only the green field is visible indicating that the retaining mechanism 20 is activated to keep that rung or bar section fixed in relation to the other bar sections. This should typically be the case when the ladder is fully extended. If the locking pin 24 is in the position shown in FIGS. 8 and 12, i.e. in the unengaged or non-locking position, only the red field is visible indicating that the retaining mechanism 20 is inactivated. If the locking pin 24 is in the position shown in FIGS. 7 and 11, i.e. in an intermediate position, both the green and the red fields are visible indicating that the retaining mechanism is partly inactivated. In the positions shown in FIGS. 7-8 and 11-12 the retaining mechanism 20 of that rung has been inactivated and the ladder is about to be completely folded and should not be used.

Figure 12:
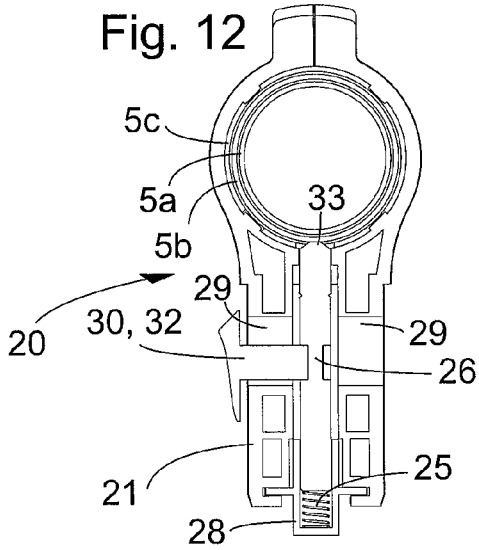
Figure 14:
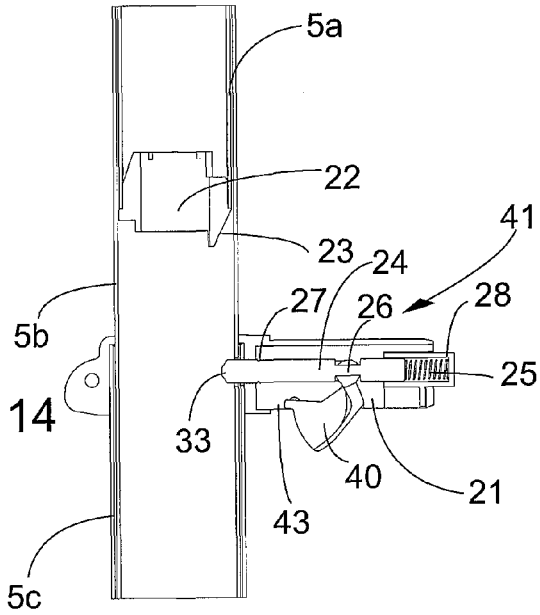
Figure 16:
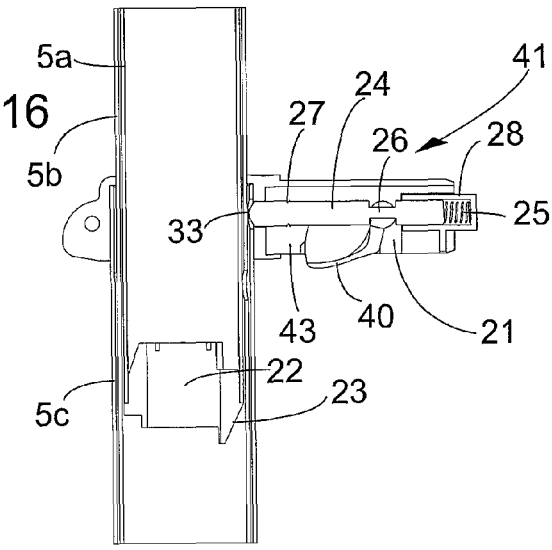

Alternatively the locking indicator 31, 42 can be arranged as colored portions of the locking pin 24. The rear portion of the locking pin 24, which visible through the recess 29 when the retaining mechanism is activated, see e.g. FIGS. 6, 10 and 14, is colored with a green color. The front portion of the locking pin 24, which visible through the recess 29 when the retaining mechanism is inactivated and retracted, see e.g. FIGS. 8, 12 and 16, is colored with a red color.

The locking pin 24 is furthermore provided with a chamfered end 33 in the end opposite to the end biased by the spring 25. The locking pin 24 interacts with a locking hole 34 of the bar section 5*b* to keep the extended position of the ladder.

The slot or slit 27 serves to prevent the locking pin 24 from projecting too far into the locking hole 34 and can for that reason be provided with a washer or can the making of the slit 27 create raisings on the locking pin that fulfills that purpose.

Figure 9:
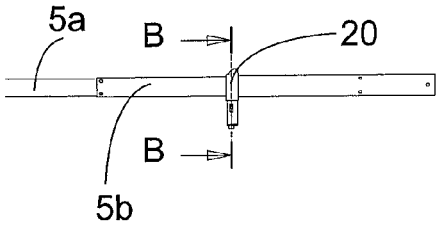
Figure 11:
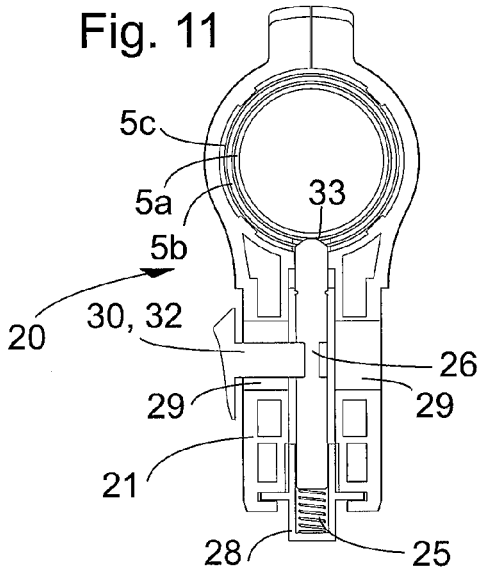

In FIG. 9 the same three bar sections 5*a*, 5*b*, 5*c* are shown with a retaining mechanism only provided on the bar section 5*c* as in FIG. 5, and where the bar sections have been rotated 90 degrees. FIGS. 10-12 shows a partial cross section of the bar sections 5*a*, 5*b*, 5*c* along the line A-A is shown. The recess 29 of the shell 21 is shown, wherein an actuator or button 32 is received. The actuator or button 32 extends through the recess 29 to clasp and jam onto the locking pin 24. The spring 25, which biases the locking pin 24, is received in a casing 28. The casing 28, which is circular, has a flange on its circumference that co-operates with corresponding recesses on the shell 21.

In FIGS. 10-12 the retaining mechanism 20 is only shown being provided with an actuator or button 32, but it is obvious that the retaining mechanism 20 provided with an actuator or button 30 is structurally identical. The difference between the two types lies in the number of bar sections positioned above the bar section having an associated rung with a retaining mechanism provided with an actuator or button 30, 32. As the actuators 30 are provided on the rung 13 in FIGS. 1 and 2, only one bar section 5 is positioned above, whereas the actuators 32 are provided on an intermediate rung, exemplified by being provided on the rung 9 in FIG. 2, which is why there can be several bar sections 5 positioned above the bar section with the actuators 32.

In FIGS. 10-12 the retaining mechanism 20 is only shown being provided with an actuator or button, but as earlier discussed the retaining mechanism 20 is provided with a ladder locking indicator 31. Similar to the actuator the ladder locking indicator 31 extends through the recess to clasp and jam onto the locking pin 24.

Now the functionality of the retaining or locking mechanism 20 used in the first and second embodiment will be described in detail.

The user inactivates the retaining mechanism 20 of top rung 13 by withdrawing the locking pin 24 from the locking hole 34 by means of the actuator or slide button 30, 32 positioned on the front side of the rung 13. The bar section 5, associated with the rung 14 and kept in position by the retaining mechanism 20 of the rung 13, is lowered by gravity. In FIG. 6 the lowering of bar section 5, associated with the rung 14, is exemplified by the bar section 5*a*, which has been released and now is lower by gravity. As bar section 5*a* reaches the locking pin 24, the inclined or chamfered surface 23 of the damper 22, arranged at the bottom end of the bar section 5*a*, will interact with locking pin 24 so that the locking pin 24 will be pushed into shell 21. This enables the bar section 5*a* to pass the locking pin 24 (see FIG. 7) and also to inactivate the locking of the bar section 5*b*, which is held by the retaining mechanism 20 and the locking pin 24, since only the chamfered end 33 of the locking pin 24 is maintaining the bar section 5*b* in position and the weight of the bar section 5*b* will push the locking pin 24 further into the shell 21 (see FIG. 8). This process will be repeated until all the below positioned bar sections are released and the ladder is folded. Thus, if a retaining mechanism 20 is inactivated the top positioned bar section (here bar section 5*a*) is released, and the top positioned bar section (here bar section 5*a*) will release and inactivate the retaining mechanism of the bar section positioned immediately below and that bar section will release and inactivate the retaining mechanism of the bar section positioned immediately below that and the process is repeated step by step until the entire ladder is completely folded, i.e. in the position shown in FIG. 1.

According to the second embodiment the folding of the ladder is made in two steps, firstly the bar sections 5 are associated with the rungs 8-11 folded by actuating the actuators 32 and secondly the bar sections 5 are associated with the rungs 12-14 folded by actuating the actuators 30. According to the first embodiment the folding of the ladder 1 and the bar sections 5, associated with the rungs 8-14, is made in one step by actuating the actuators 30.

Figure 13:
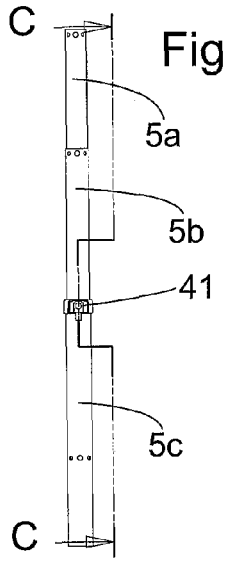
FIGS. 13-16 show different views of the locking mechanism according to the third embodiment of the invention.

Similar to FIGS. 5 and 9, FIG. 13 only shows three bar sections 5*a*, 5*b*, 5*c* with a retaining mechanism only provided on the bar section 5*c*, whereas the rest of the ladder has been removed for clarity reasons. The bar section 5*a* having the smaller diameter telescopes into the bar section 5*b*, and the bar section 5*b* telescopes into the bar section having the greater diameter.

Figure 15:
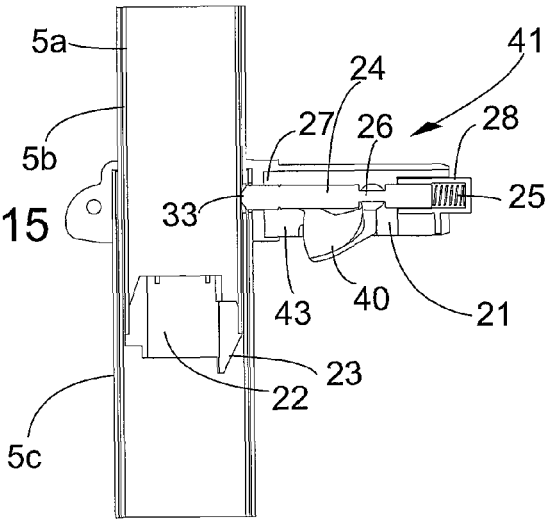

FIGS. 14-16 show a partial cross section of the bar sections 5*a*-5*c* along the line A-A. The retaining mechanism 41 differs from the retaining mechanism 20 in that the actuator 40 connected to retaining mechanism 41 projects through a recess on the underside of the rung, whereas the actuator 30, 32 connected to retaining mechanism 20 projects through a recess on the front side of the rung.

Similar to the first embodiment every bar section 5, except the lower most bar sections, is provided with a damper 22 at its lower end. The damper 22 is provided with an inclined surface 23.

The actuator 40 is a rotary button and is pivotably mounted spindle 45 on the shell 21 and having a connecting part (fork-shaped) of the button 40 clasps or jams about the waist or recess 26 of the locking pin 24. The rotary button 40, which is roughly L-shaped, extends through a recess 43 of the bottom of the shell 21 projecting out of a recess on the underside face of the rung. In a locking position, one of the legs of the rotary button projects obliquely out from the recess, whereas the other leg, e.g. having a fork-shaped and rounded end, grasps the recess portion 26 of the locking pin 24. Other structure of the retaining mechanism 41 is similar to the retaining mechanism 20.

The functionality of the retaining mechanism 41 is similar to the functionality of the retaining mechanism 20. The user inactivates the retaining mechanism 41 of bar section 5*c* by withdrawing the locking pin 24 from the locking hole 34 by means of the actuator or rotary button 40 positioned on the underside of the rung associated with the bar section 5*c*. The bar section 5*b* associated with the rung positioned above the inactivated of released the bar section 5*c* and kept in position by the retaining mechanism 41 of bar section 5*c* and its associated rung is lowered by gravity. In FIG. 14 the bar section 5*a* has been released and now is lower by gravity. As bar section 5*a* reaches the locking pin 24, the inclined or chamfered surface 23 of the damper 22, arranged at the bottom end of the bar section 5*a*, will interact with locking pin 24 so that the locking pin 24 will be pushed into shell 21. This enables the bar section 5*a* to pass the locking pin 24 (see FIG. 15) and also to inactivate the locking of the bar section 5*b*, which is held by the retaining mechanism 41 and the locking pin 24, since only the chamfered end 33 of the locking pin 24 is maintaining the bar section 5*b* in position and the weight of the bar section 5*b* will push the locking pin 24 further into the shell 21 (see FIG. 16). This process will be repeated until all the below positioned bar sections are released and the ladder is folded.

Simultaneously thereto the folding of the bar sections, associated with rungs that have been released and lowered, i.e. the initially released bar section and every bar section positioned below the initially released bar section of the third embodiment as described above, the folding of the bar sections associated with the rung positioned above the initially released bar section will be initiated. The initiation of the folding of the bar sections associated with the rungs above the initially released bar section is due to the functionality of the retaining mechanism 41. As the rung of a released bar section reaches a lower rung of an immediately below positioned bar section, the retaining mechanism 41 of the upper positioned bar section is released when the rotary button is pushed into the recess of the upper rung by the lower rung, and thereby releases the retaining mechanism 41. This will be repeated until every bar section positioned above the actuator has been folded.

Figure 17:
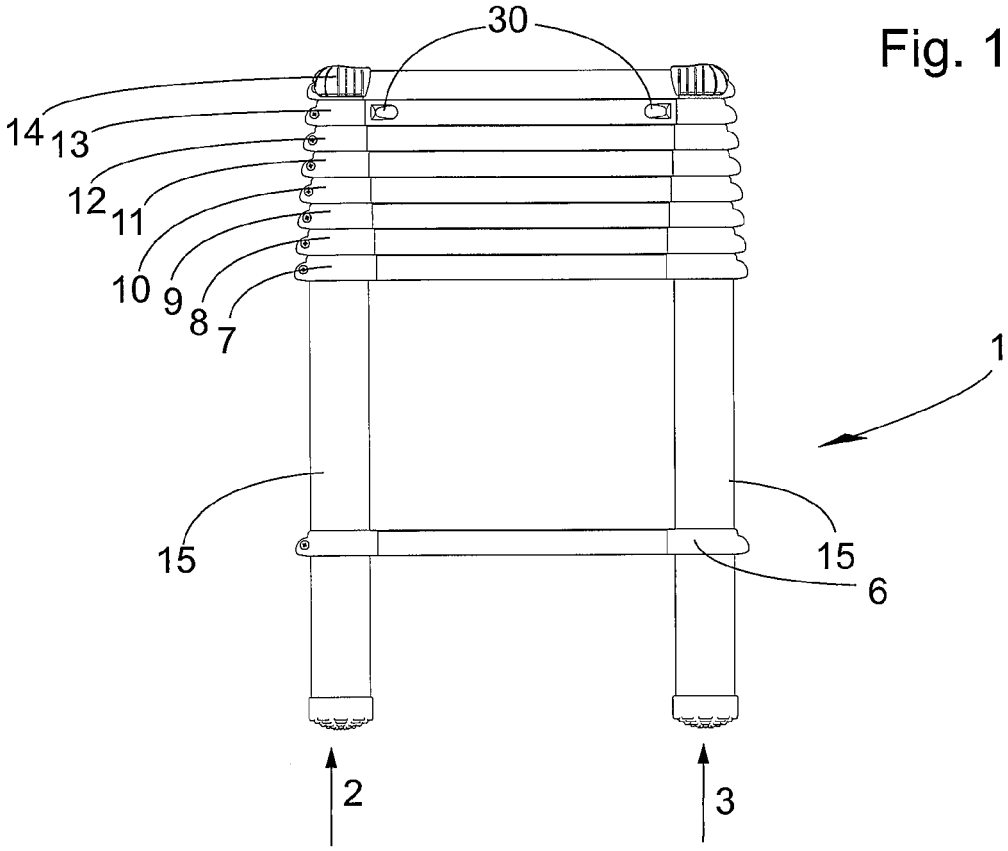
FIGS. 17-18 show alternative configurations of the collapsible ladders according to the first and the third embodiment of the inventions.

FIG. 17 shows an alternative configuration of the collapsible ladder according to the first embodiment of the invention. The ladder is provided with actuators 30, 32 similar to the ladder according to the first embodiment of the invention, but without the locking indicators 31. This alternative configuration could perhaps be preferable for professional users that handle the ladder frequently and are very familiar with its functionality. The ladder according to the first and/or second embodiment with locking indicators can be directed to the consumer market, where the user uses the ladder less frequently.

Figure 18:
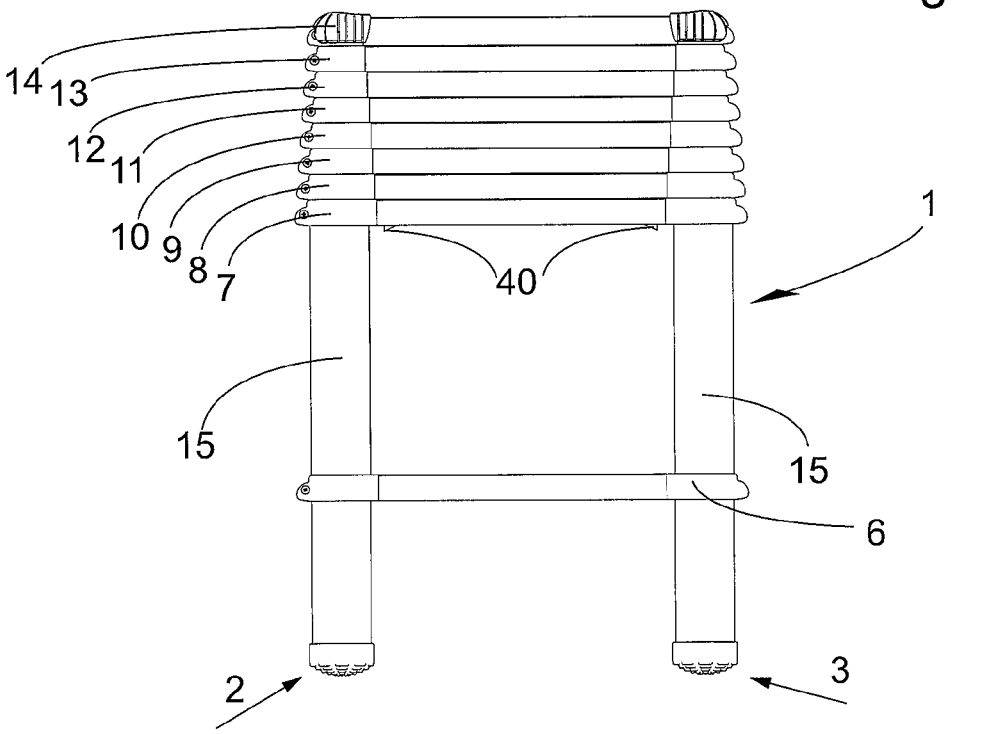

FIG. 18 shows an alternative configuration of the collapsible ladder according to the third embodiment of the invention. The ladder is provided with actuators 40 similar to the ladder according to the third embodiment of the invention, but without the locking indicators 41. This alternative configuration could perhaps be preferable for professional users that handle the ladder frequently and are very familiar with its functionality. The ladder according to the first or second embodiment with locking indicators can be directed to the consumer market, where the user uses the ladder less frequently.

It is vital that the chamfering has a depth from the end of the locking pin to the end of the chamfering that exceeds the total length measure of the space between two adjacent ladder bars and the thickness of the ladder bars. Beside this a security margin is needed to match any tolerances. This total length measure of the chamfering is crucial for the locking mechanism to function and for the locking pin to be further retracted, after that the chamfering of the damper has retracted the locking pin in the first phase of the releasing of the ladder sections.

In previous solutions some of the collapsible ladders are provided with locking pins having a rounded end, but the rounded end serves as a soft surface as the locking pins slide against the inner surface of the bars by means of the spring. The rounded end solves the problem of enabling a smooth sliding of the locking pins against the inner surface of the bars.

Even though the actuators to inactivate the retaining mechanism have been shown being arranged on the underside or the front of the rungs, it is evident that other solutions also are possible. For example can the actuators be arranged on topside of the bar sections associated with the upper most rung 14, where each actuator is connected to a link arm or a system of link arms that enable the actuators inactivate the upper most retaining mechanisms and thereby enabling the folding of the ladder. Another possible solution would be to arrange the actuators on the outside of the bar sections, at least on the upper most bar section, where each actuator again is connected via some sort of an arrangement to the upper most retaining mechanisms and thereby enabling the folding of the ladder by means of the actuators.

Even though it has not been shown by the detailed embodiment or the drawings it is evident that the claimed locking mechanism can be used on a stepladder. A collapsible stepladder comprises a first and a second ladder leg. The legs are hingedly connected to each other in one end, and where each of the ladder legs can be seen as an individual collapsible ladder as the ladders shown in FIGS. 1-4*b*.

The invention according to the claims secures that a stepladder is provided the claimed locking mechanism can only be used when both ladder legs are fully extended. If any of the locking mechanism of any of the ladder section or ladder legs are released or inactivated, all ladder section of that ladder leg will collapse or fold entirely by means of the claimed invention.

The invention is not limited to the embodiments described above and shown on the drawings, but can be supplemented and modified in any manner within the scope of the invention as defined by the enclosed claims.

The invention claimed is:

1. A locking mechanism for a collapsible ladder comprising a plurality of ladder sections, each ladder section comprising two ladder bars arranged parallel to each other and interconnected at one end by a rung to form a U-shaped ladder section, and where each ladder section, excluding a lowermost ladder section, is telescopically inserted into a lower ladder section to form a collapsible ladder, and where dampers are provided at a lower end of the ladder bars, and where the locking mechanism comprises retaining mechanisms provided on each ladder bar, adjacent an upper end of each ladder bar and a locking hole adjacent the lower end of each ladder bar, and where each retaining mechanism comprises a locking pin being spring biased towards an extended position in order to engage the locking hole provided in the ladder bars of a ladder section positioned thereabove, wherein the locking mechanism further comprises actuators to release the retaining mechanisms, the actuators being arranged on at least one of the ladder sections, and where each of the dampers of the ladder sections are provided with a chamfered surface, the chamfered surface of the dampers being arranged to cooperate with each locking pin of the ladder section to retract the locking pin of the ladder sections from the extended position and locked position to an intermediate position, when an above-positioned ladder section is released and lowered, and where each locking pin is provided with a chamfered end, the chamfered end of each locking pin of the ladder sections enabling each locking pin to be further retracted from the intermediate position to be entirely retracted from the locking hole, and releasing a ladder section positioned below the released above-positioned ladder section, enabling folding or lowering of all the ladder sections positioned below a released ladder section.

2. The locking mechanism according to claim 1, wherein a first pair of actuators is provided on a front side of a second uppermost rung.

3. The locking mechanism according to claim 1, wherein a first pair of actuators is provided on a front side of a second uppermost rung, and where a second pair of actuators is provided on a front side of a rung positioned between the second uppermost rung and a second lowermost rung.

4. The locking mechanism according to claim 3, wherein the second pair of actuators enables lowering of a lower part of the collapsible ladder, and where the first pair of actuators enables lowering of an upper part of the collapsible ladder.

5. The locking mechanism according to any one of claims 1-4, wherein each retaining mechanism further comprises a button that cooperates with the locking pin and projects through a recess on a front side of the rung, and which is arranged to release the retaining mechanism when the button retracts the locking pin from an extended position.

6. The locking mechanism according to claim 1, wherein the actuators are provided on any or all of the ladder sections, the actuators enabling folding of the collapsible ladder.

7. The locking mechanism according to claim 6, wherein the retaining mechanism further comprises a lever that cooperates with the locking pin and projects through a recess on an underside of the rung, and which is arranged to release the retaining mechanism, when the rung of the ladder section is collapsed against the rung positioned below and the lever is pushed into the rung and retracts the locking pin from an extended position.

8. The locking mechanism according to claim 6 or 7, wherein an actuation of a pair of the actuators enables lowering of a part of the collapsible ladder positioned below actuated actuators, and where an actuated pair of the actuators enables lowering of the ladder sections positioned above the actuated pair of the actuators.

9. A collapsible ladder comprising: a plurality of ladder sections, each ladder section comprising two ladder bars arranged parallel to each other and interconnected at one end by a rung to form a U-shaped ladder section; each ladder section, excluding a lowermost ladder section, being telescopically inserted into a lower ladder section to form a collapsible ladder comprising at least three ladder sections, wherein the collapsible ladder includes the locking mechanism according to claim 1.

10. The collapsible ladder according to claim 9, wherein the ladder sections associated with rungs that are not provided with the actuators, but being collapsible, are provided with locking indicators, to enable visualization of whether the retaining mechanisms of the ladder sections are in a locked position or not.

11. The collapsible ladder according to claim 9, wherein the ladder sections associated with rungs are provided with locking indicators, to enable visualization of whether the retaining mechanisms of the ladder sections are in a locked position or not.

12. The collapsible ladder according to claim 10 or 11, wherein each of the locking indicators include two fields, which are visual on a front side of the rungs, a first field with a first indicator which is visual when the locking pin is withdrawn from a respective ladder bar, and a second field with a second indicator which is visual when the locking pin is in a locking position.

13. The collapsible ladder according to claim 12, wherein each locking indicator comprises small plates provided inside the rungs and following movements of respective locking pins from an extended position to a retracted position and movements opposite thereto, the locking indicator being visual through an elongated aperture or recess on the front side of the rungs.

14. The collapsible ladder according to claim 12, wherein the locking indicators comprise colored portions of the locking pin, where a rear portion of the locking pin is visible when the locking pin is in a locking position, and a front portion of the locking pin is visual when the locking pin is retracted from the locking position or inactivated.

15. A collapsible stepladder comprising a first ladder leg and a second ladder leg, where the first ladder leg and the second ladder leg are hingedly connected to each other in one end, and where each of the first ladder leg and the second ladder leg comprises a plurality of ladder sections, each of said ladder sections comprising two ladder bars arranged parallel to each other and interconnected at one end by a rung to form a U-shaped ladder section; each of said ladder sections, excluding a lowermost ladder section, being telescopically inserted into a lower ladder section to form a collapsible stepladder comprising at least three ladder sections, wherein the collapsible stepladder includes the locking mechanism according to claim 1.

16. The collapsible stepladder according to claim 15, wherein the ladder sections are provided with locking indicators, to enable visualization of whether the retaining mechanisms of the ladder sections are in a locked position or not.

* * * * *